US007518556B2

(12) United States Patent
Kurashima et al.

(10) Patent No.: US 7,518,556 B2
(45) Date of Patent: Apr. 14, 2009

(54) ANTENNA

(75) Inventors: Shigemi Kurashima, Shinagawa (JP); Masahiro Yanagi, Shinagawa (JP); Hideki Iwata, Shinagawa (JP); Takashi Yuba, Shinagawa (JP); Masahiro Kaneko, Shinagawa (JP); Yuriko Segawa, Shinagawa (JP); Takashi Arita, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 53 days.

(21) Appl. No.: 11/584,574

(22) Filed: Oct. 23, 2006

(65) Prior Publication Data

US 2007/0229362 A1 Oct. 4, 2007

(30) Foreign Application Priority Data

Mar. 30, 2006 (JP) ..... 2006-094428

(51) Int. Cl.
*H01Q 1/32* (2006.01)

(52) U.S. Cl. ..... 343/700 MS; 343/846

(58) Field of Classification Search ..... 343/700 MS, 343/846, 829, 848
See application file for complete search history.

(56) References Cited

U.S. PATENT DOCUMENTS

| | | | | |
|---|---|---|---|---|
| 6,535,172 | B2 * | 3/2003 | Hirabayashi | 343/725 |
| 6,756,936 | B1 * | 6/2004 | Wu | 342/175 |
| 7,245,196 | B1 * | 7/2007 | Baliarda et al. | 333/219 |
| 2006/0082501 | A1 * | 4/2006 | Chiang | 342/442 |
| 2006/0178106 | A1 * | 8/2006 | Utakouji et al. | 455/11.1 |
| 2007/0164838 | A1 * | 7/2007 | Iskander et al. | 333/161 |

OTHER PUBLICATIONS

Takuya Taniguchi et al., "An Omnidirectional and Low-VSWR Antenna for the FCC-Approved UWB Frequency Band", *The General Conference of the Institute of Electronics, Information and Communication Engineers*, 2003, B-1-133, p. 133.

* cited by examiner

*Primary Examiner*—Tho G Phan
(74) *Attorney, Agent, or Firm*—Staas & Halsey LLP

(57) ABSTRACT

An antenna which can be used in different communication standards with a simple structure is disclosed. The antenna includes an antenna section which receives/transmits radio waves, input/output ports to which a signal to be input to the antenna section is input and from which a signal output from the antenna section is output, and transmission lines each of which connects the antenna section to a corresponding input/output port.

8 Claims, 13 Drawing Sheets

ANTENNA

BACKGROUND OF THE INVENTION

1. Field of the Invention

The present invention generally relates to an antenna which can be used in wide band communications.

2. Description of the Related Art

Recently, a radio communication technology utilizing UWB (ultra-wide band) has been used. UWB has a radar function, a positioning function, and a radio communication function; and was approved to use the 3.1 to 10.6 GHz band by the US FCC (Federal Communications Commission) in 2002.

UMB is a radio communication technology in which pulse signals are used in an ultra wide band. Therefore, an antenna which is used in UWB must have a structure which can transmit/receive signals in the ultra wide band.

An antenna for use in the 3.1 to 10.6 GHz band approved by the FCC is proposed, which antenna includes a base plate and a power supply body (Non-Patent Document 1).

[Non-Patent Document 1] An Omnidirectional and Low-VSWR Antenna for the FCC-Approved UWB Frequency Band, written and proposed by Takuya Taniguchi and Takehiko Kobayashi, in The General Conference of The Institute of Electronics, Information and Communication Engineers, in 2003.

As a radio communication technology, there are a wireless LAN (local area network) and Bluetooth other than UWB. An antenna using UWB can be used in frequency bands of the wireless LAN and Bluetooth. Therefore, the antenna using UWB (UWB antenna) can be common in plural radio communication technologies including the wireless LAN, Bluetooth, and UWB. Consequently, when a common antenna such as the UWB antenna is used, antenna space can be less than that of plural antennas for various technologies.

SUMMARY OF THE INVENTION

The present invention may provide an antenna which can be used in common in different radio communication technologies with a simple structure.

According to one aspect of the present invention, there is provided an antenna. The antenna includes an antenna section which receives/transmits radio waves, input/output ports to which a signal to be input to the antenna section is input and from which a signal output from the antenna section is output, and transmission lines each of which connects the antenna section to a corresponding input/output port.

According to another aspect of the present invention, the antenna section includes an element pattern and a ground pattern which patterns are conductive patterns formed on a dielectric material board.

According to another aspect of the present invention, the element pattern, the input/output ports, and the transmission lines are formed on one surface of the dielectric material board; the ground pattern is formed on the other surface of the dielectric material board; and a microstrip transmission line is formed of the transmission lines and the ground pattern.

According to another aspect of the present invention, the element pattern, the ground pattern, the input/output ports, and the transmission lines are formed on one surface of the dielectric material board; and a co-planar transmission line is formed of the transmission lines and the ground pattern.

According to another aspect of the present invention, a filter circuit is formed in the transmission line.

According to another aspect of the present invention, the antenna section is connected to the input/output ports via a coupler instead of the transmission lines.

According to another aspect of the present invention, the coupler is a 3 dB branch line or a power divider.

According to another aspect of the present invention, the antenna further includes a switching circuit which connects the antenna section to a suitable one of the transmission lines.

According to another aspect of the present invention, the antenna section is capable of communicating in at least a UWB frequency band and a wireless LAN frequency band.

According to an embodiment of the present invention, the antenna includes an antenna section which receives/transmits radio waves, input/output ports to which a signal to be input to the antenna section is input and from which a signal output from the antenna section is output, and transmission lines each of which connects the antenna section to a corresponding input/output port. Therefore, the antenna can be used in different communication standards with a simple structure.

Features and advantages of the present invention will be apparent from the following detailed description when read in conjunction with the accompanying drawings.

DESCRIPTION OF THE PREFERRED EMBODIMENTS

Figure 1:
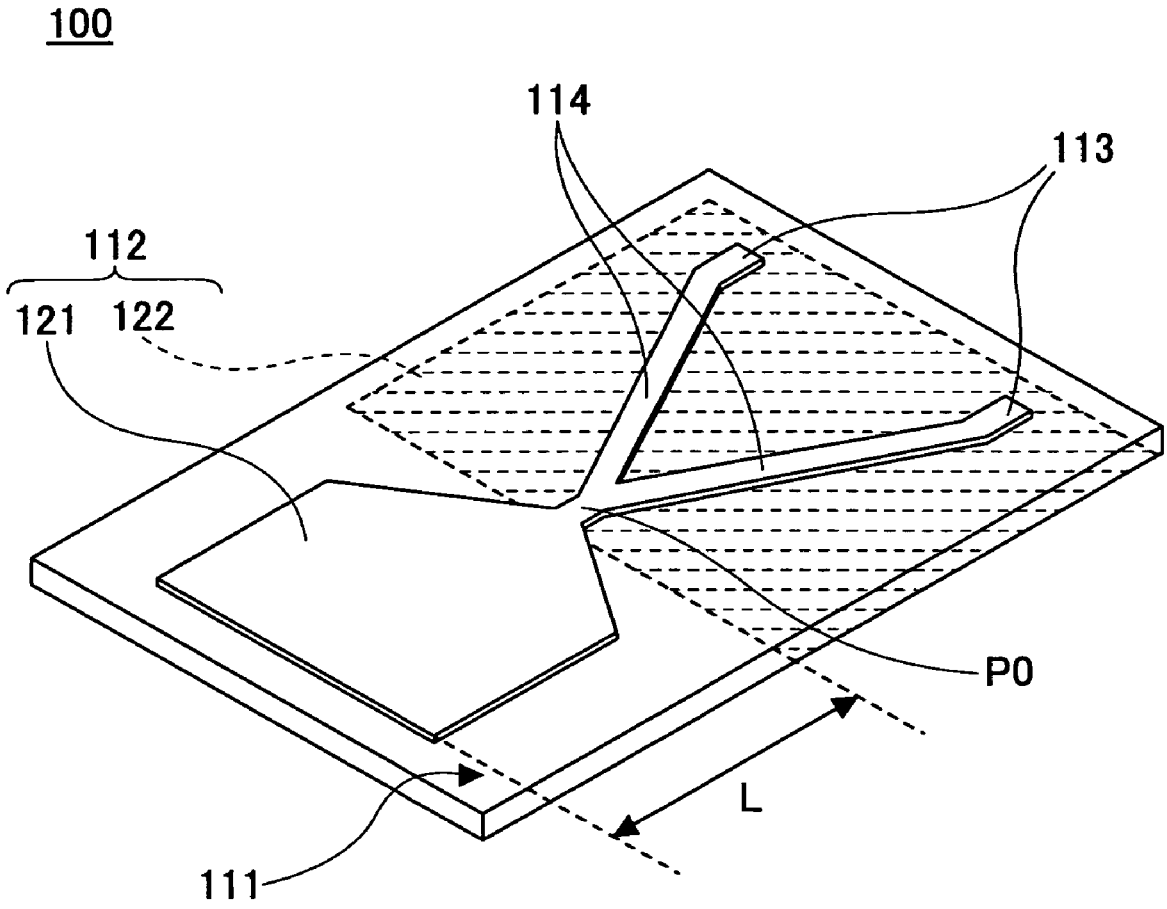
FIG. 1 is a perspective view of an antenna according to a first embodiment of the present invention.

Referring to the drawings, embodiments of the present invention are described.

First Embodiment

Figure 2:
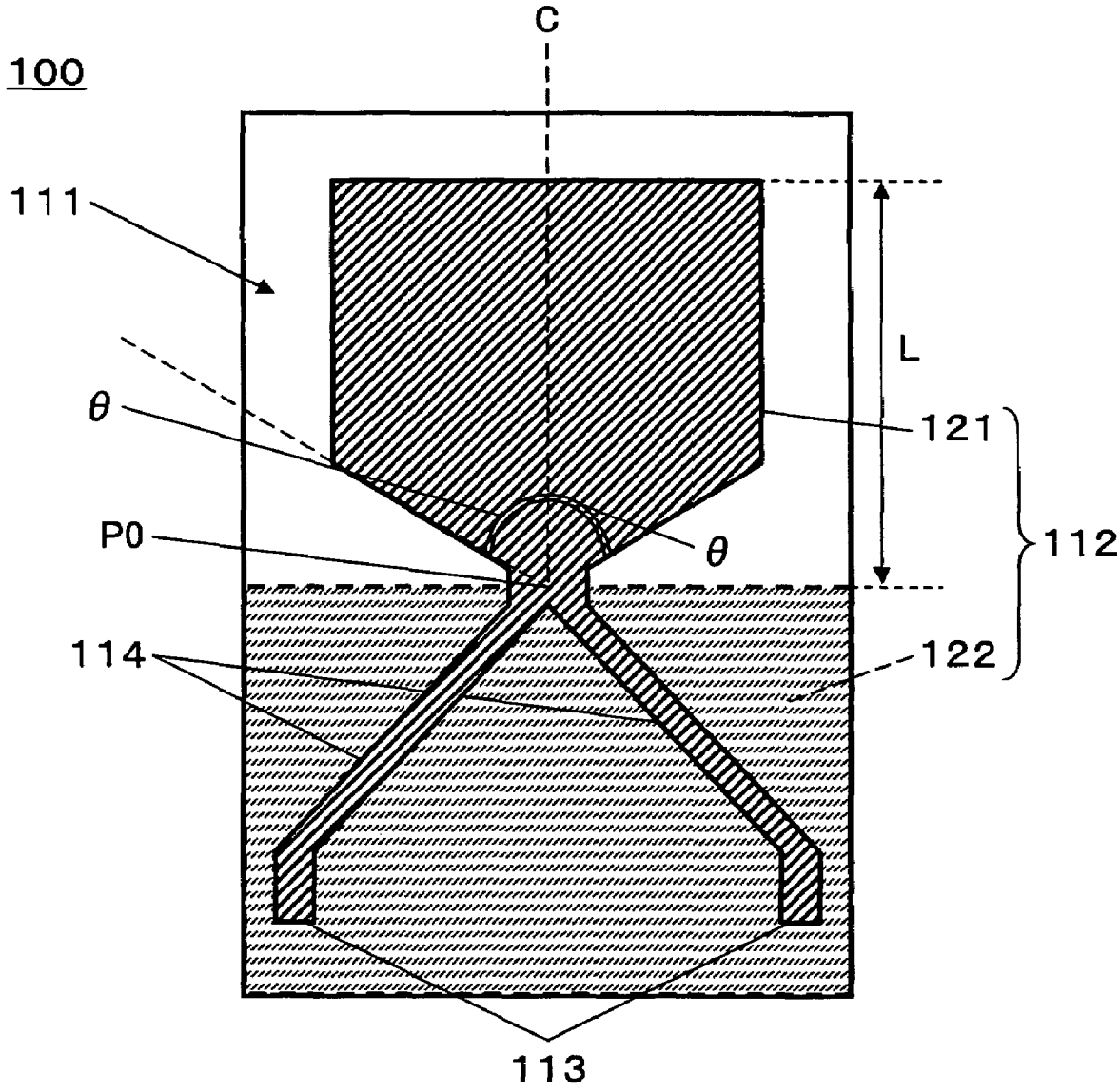
FIG. 2 is a plan view of the antenna shown in FIG. 1.

FIG. 1 is a perspective view of an antenna according to a first embodiment of the present invention. FIG. 2 is a plan view of the antenna shown in FIG. 1.

Referring to FIGS. 1 and 2, the antenna according to the first embodiment of the present invention is described.

An antenna 100 in the first embodiment of the present invention includes a printed circuit board 111 on which an antenna section 112, input/output ports 113, and transmission lines 114 are formed of conductive patterns.

The base board of the printed circuit board 111 is made of a dielectric material such as FR-4 and ceramics and the conductive patterns are formed on the surface of the base board by a conductive material such as copper and aluminum.

The antenna section 112 is formed of the conductive patterns formed on the surface of the printed circuit board 111 and includes an element pattern 121 and a ground pattern 122.

The element pattern 121 is formed on a first surface of the printed circuit board 111 with a pentagon shape similar to home plate. A power supply point P0 of the element pattern 121 is formed at the position facing the ground pattern 122. One side of the element pattern 121 whose end is connected to the power supply point P0 has an angle θ measured from the center line C of the element pattern 121. Similar to the one side, the other side has the angle θ. The angle θ is, for example, approximately 63°.

The ground pattern 122 is formed on a second surface of the printed circuit board 111 covering almost all half of the second surface on whose reverse side (first surface) the element pattern 121 is not formed. One side of the ground pattern 122 which side faces the element pattern 121 is located at a position near the power supply point P0 without contacting the power supply point P0. The element pattern 121 is insulated from the ground pattern 122 by the dielectric board of the printed circuit board 111.

The input/output ports 113 and the transmission lines 114 are formed on the first surface of the printed circuit board 111 at the part where the element pattern 121 is not formed. Each of the input/output ports 113 is connected to the power supply point P0 of the element pattern 121 via the corresponding transmission line 114. Each of the input/output ports 113 is connected to a high-frequency circuit via a connector or a coaxial cable.

For example, one of the input/output ports 113 is connected to a high-frequency circuit for UWB and the other of the input/output ports 113 is connected to a high-frequency circuit for a wireless LAN.

A microstrip transmission line is formed by one of the transmission lines 114 and the ground pattern 122. With this, the characteristic impedance of the transmission line 114 is determined to be, for example, 50Ω.

A signal line of the connector or the coaxial cable is connected to the input/output port 113 and a shielding line of the connector or the coaxial cable is connected to the ground pattern 122.

Figure 3:
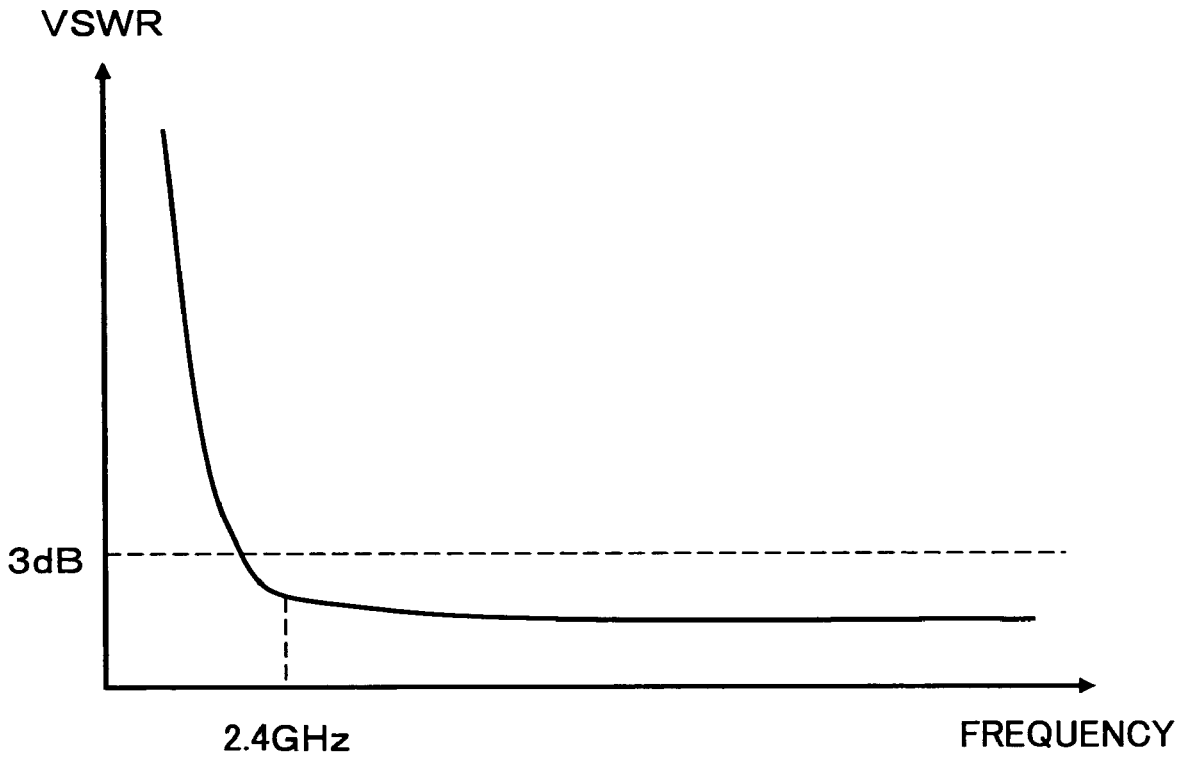
FIG. 3 is a graph showing a VSWR (voltage standing wave ratio) of the antenna shown in FIG. 1.

FIG. 3 is a graph showing a VSWR (voltage standing wave ratio) of the antenna 100 shown in FIG. 1. As shown in FIG. 3, the VSWR of the antenna 100 can be a value less than a predetermined value at a gain 3 dB when the frequency is 2 GHz or more. With this, communications can be executed in the frequency band of 2.4 GHz of the wireless LAN and in UWB which includes the frequency band of 3.1 GHz and more.

In the antenna 100, when the length L (FIG. 1) of the element pattern 121 or the length (not shown) of the ground pattern 122 in the direction orthogonal to the direction facing the element pattern 121 is made greater, the VSWR in a low frequency band is increased. For example, when the length L of the element pattern 121 is approximately 15 mm, the VSWR is increased when the frequency is approximately 3.0 GHz or less; however, when the length L of the element pattern 121 is approximately 20 to 25 mm, the VSWR is increased when the frequency is approximately 2 GHz or less. That is, when the length L is made greater, the VSWR can be improved.

Consequently, when the length L of the element pattern 121 is determined to be 20 to 25 mm, the antenna 100 can be applied to a wireless LAN at 2.4 MHz.

As described above, according to the first embodiment of the present invention, since the antenna section 112 can be common for the plural input/output ports 113, the antenna 100 can be used in communications of, for example, UWB and a wireless LAN.

Second Embodiment

Figure 4:
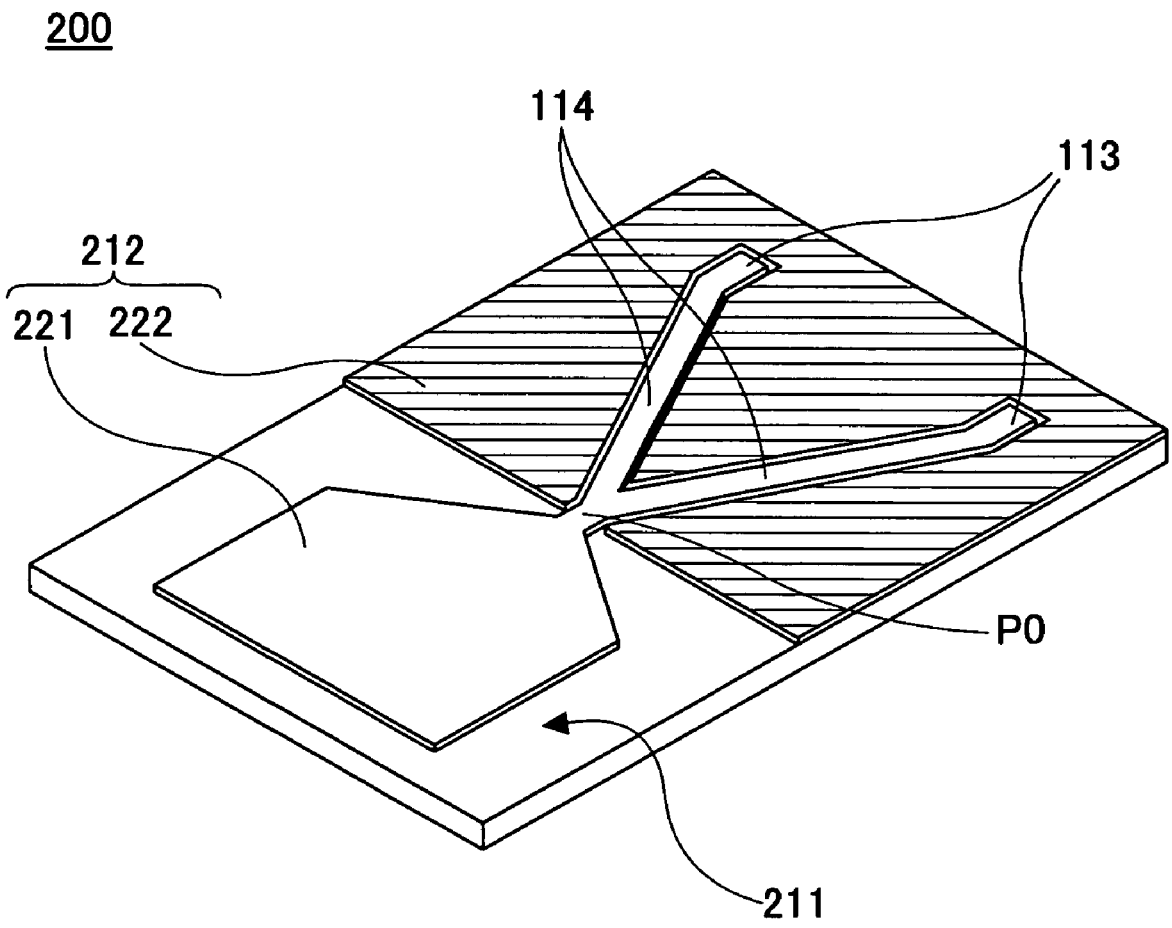
FIG. 4 is a perspective view of an antenna according to a second embodiment of the present invention.
Figure 5:
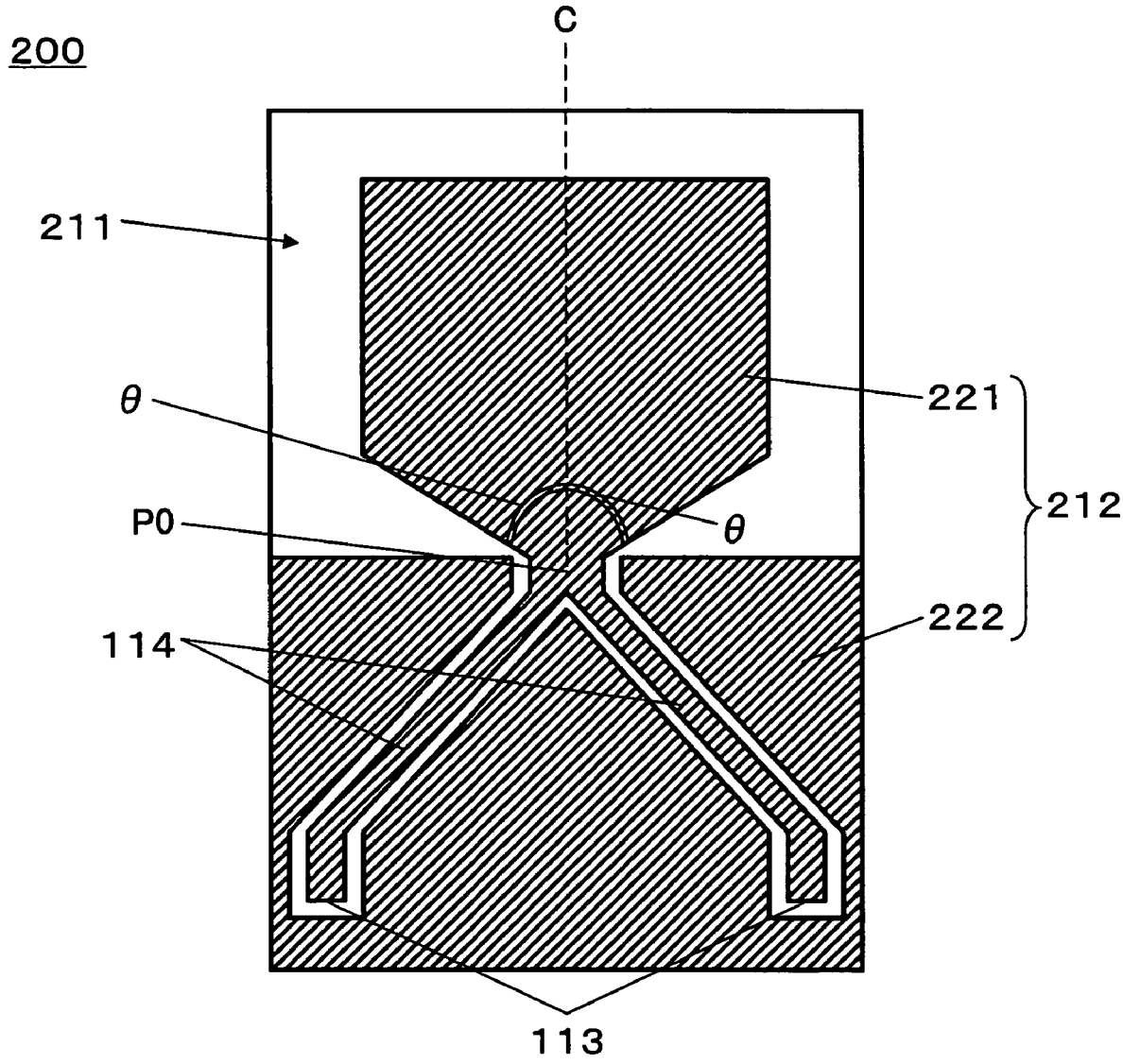
FIG. 5 is a plan view of the antenna shown in FIG. 4.

FIG. 4 is a perspective view of an antenna according to a second embodiment of the present invention. FIG. 5 is a plan view of the antenna shown in FIG. 4.

Referring to FIGS. 4 and 5, the antenna according to the second embodiment of the present invention is described. In FIGS. 4 and 5, some elements are the same as those shown in FIGS. 1 and 2, and each of the same elements has the same reference number; therefore, the same description is omitted.

An antenna 200 in the second embodiment of the present invention includes a printed circuit board 211 on which an antenna section 212, input/output ports 113, and transmission lines 114 are formed of conductive patterns.

The base board of the printed circuit board 211 is made of a dielectric material such as FR-4 and ceramics and the conductive patterns are formed on the surface of the base board by a conductive material such as copper and aluminum.

The antenna section 212 is formed of conductive patterns formed on a first surface of the printed circuit board 211 and includes an element pattern 221 and a ground pattern 222.

The element pattern 221 is formed on one part of the first surface of the printed circuit board 211 with a pentagon shape similar to home plate. A power supply point P0 of the element pattern 221 is formed at the position facing the ground pattern 222 without contacting the ground pattern 222. One side of the element pattern 221 whose end is connected to the power supply point P0 has an angle θ measured from the center line C of the element pattern 221. Similar to the one side, the other side has the angle θ. The angle θ is, for example, approximately 63°.

The ground pattern 222 is formed on the other part of the first surface of the printed circuit board 211 covering almost all the other part. That is, the element pattern 221, the ground pattern 222, the input/output ports 113, and the transmission lines 114 are formed on the first surface of the printed circuit board 211. The input/output ports 113 and the transmission lines 114 are insulated from the ground pattern 222 by forming a gap therebetween. Further, the element pattern 221 is insulated from the ground pattern 222 by forming a gap therebetween.

Each of the input/output ports 113 is connected to the power supply point P0 of the element pattern 221 via the corresponding transmission line 114. Each of the input/output port 113s is connected to a high-frequency circuit via a connector or a coaxial cable.

For example, one of the input/output ports 113 is connected to a high-frequency circuit for UWB and the other of the input/output ports 113 is connected to a high-frequency circuit for a wireless LAN.

A co-planar transmission line is formed by the transmission lines 114 and the ground pattern 222. With this, the characteristic impedance of the transmission line 114 is determined to be, for example, 50Ω.

A signal line of the connector or the coaxial cable is connected to the input/output port 113 and a shielding line of the connector or the coaxial cable is connected to the ground pattern 222.

As described above, according to the second embodiment of the present invention, since the antenna section 212 can be common for the plural input/output ports 113, the antenna 200 can be used in, for example, UWB and a wireless LAN.

Third Embodiment

Figure 6:
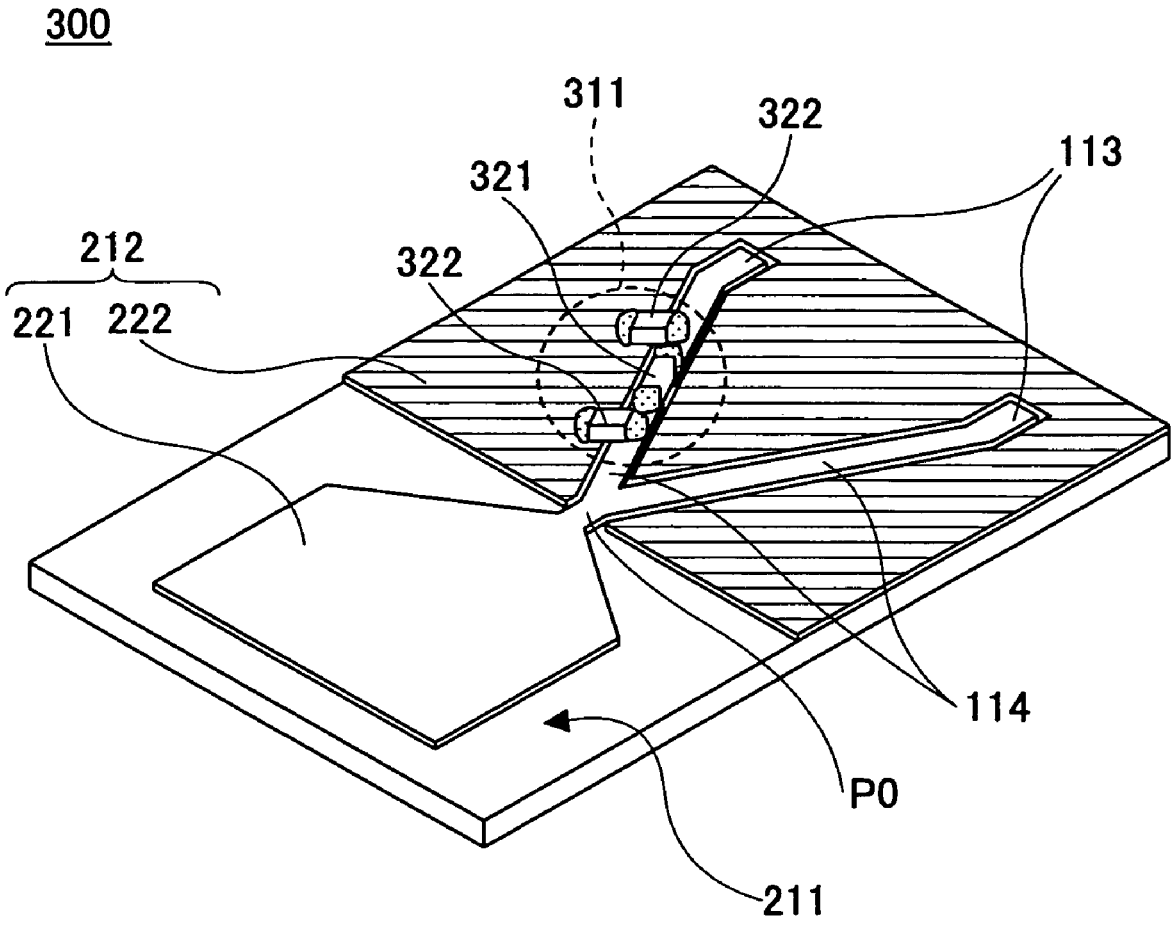
FIG. 6 is a perspective view of an antenna according to a third embodiment of the present invention.
Figure 7:
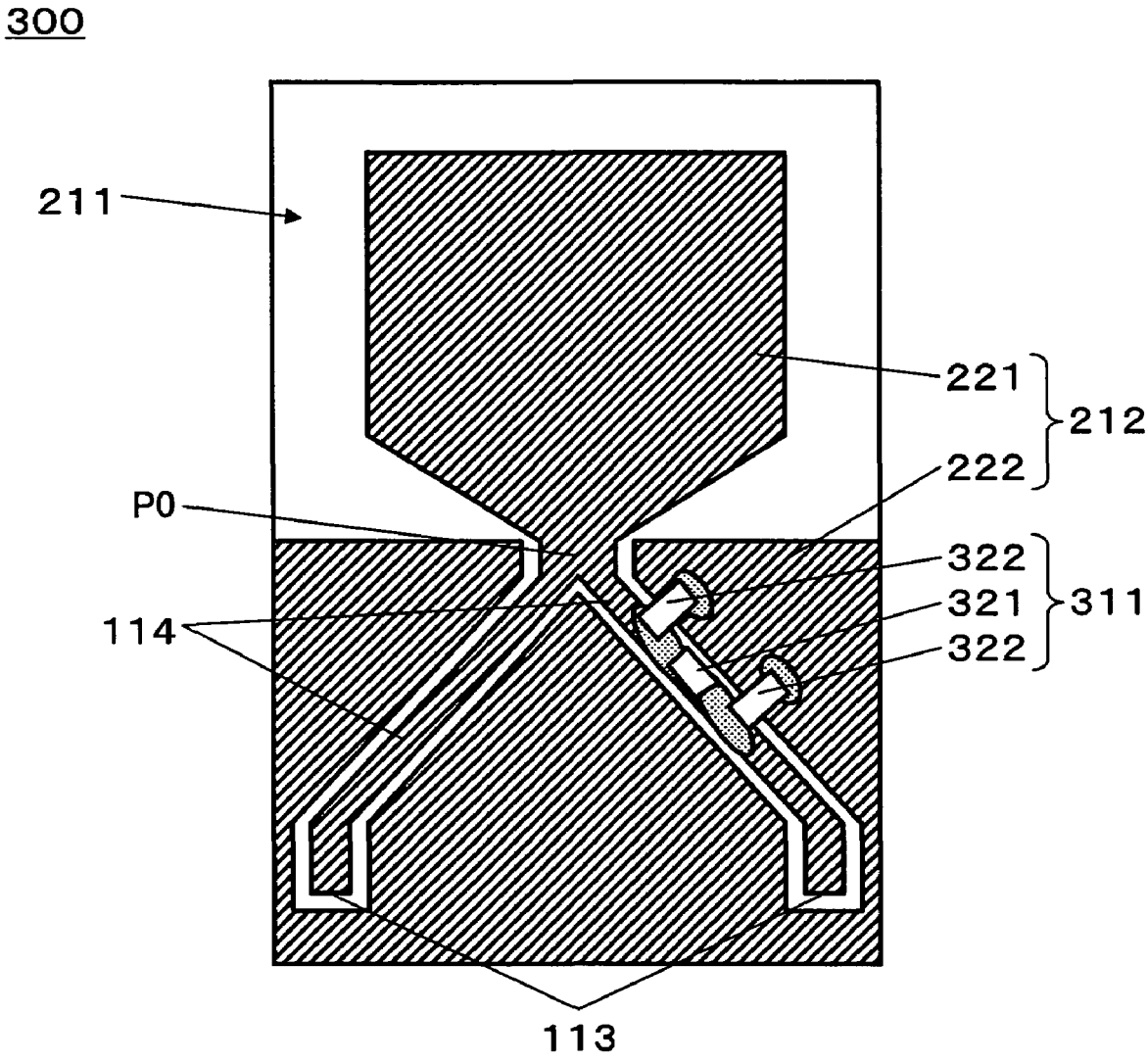
FIG. 7 is a plan view of the antenna shown in FIG. 6.

FIG. 6 is a perspective view of an antenna according to a third embodiment of the present invention. FIG. 7 is a plan view of the antenna shown in FIG. 6.

Referring to FIGS. 6 and 7, the antenna according to the third embodiment of the present invention is described. In FIGS. 6 and 7, some elements are the same as those shown in FIGS. 4 and 5, and each of the same elements has the same reference number; therefore the same description is omitted.

In an antenna 300 of the third embodiment of the present invention, one of the plural transmission lines 114 includes a filter circuit 311. In the filter circuit 311, a chip capacitor 321 is inserted into the transmission line 114 and the transmission line 114 is connected to the ground pattern 222 via chip inductors 322. That is, a band pass filter is formed by the filter circuit 311.

Figure 8:
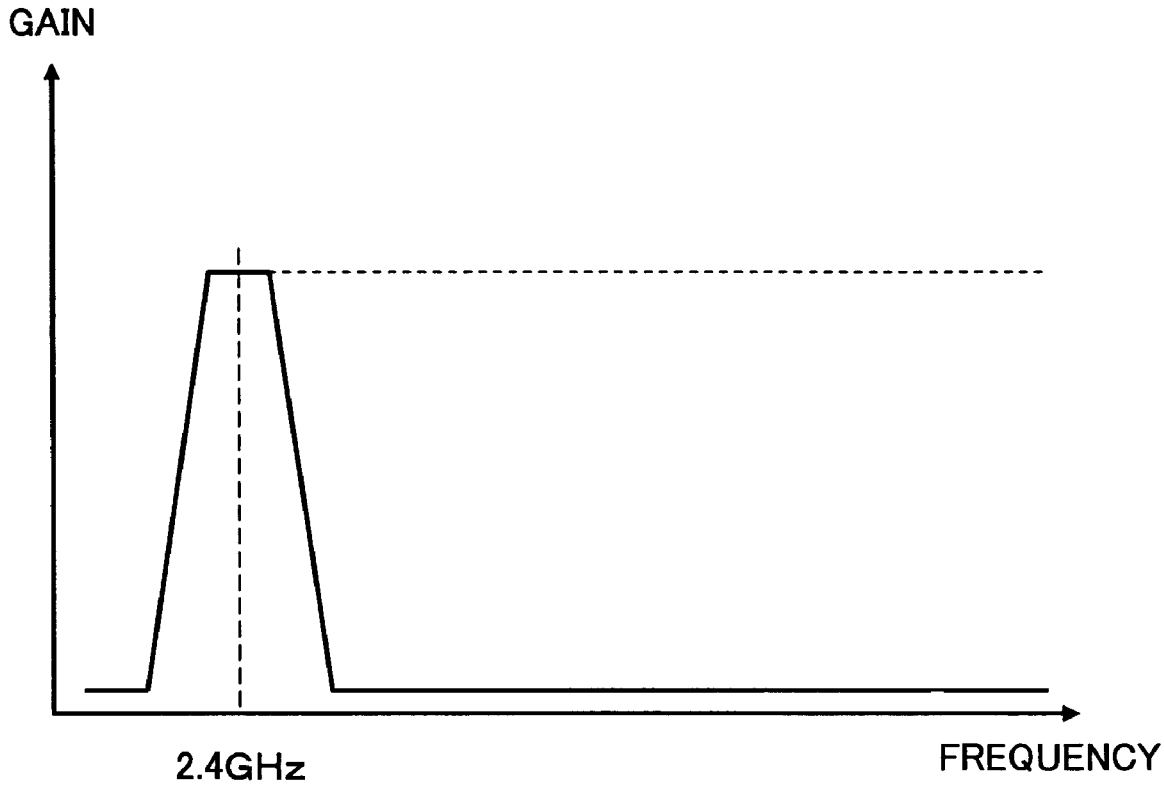
FIG. 8 is a graph showing a frequency characteristic of a filter circuit shown in FIG. 6.

FIG. 8 is a graph showing a frequency characteristic of the filter circuit 311 shown in FIG. 6. As shown in FIG. 8, the filter circuit 311 passes a signal of, for example, 2.4 MHz band of, for example, the wireless LAN or Bluetooth, and attenuates a signal of a lower or higher frequency than that of the 2.4 MHz band.

When a high-frequency circuit for the wireless LAN is connected to the input/output port 113 connected to the transmission line 114 in which the filter circuit 311 is disposed, and a high-frequency circuit for UWB is connected to the input/output port 113 connected to the other transmission line 114, a process in the high-frequency circuit for the wireless LAN can be simplified. In addition, wireless LAN communications can be executed without being affected by unnecessary frequency components.

In addition, the filter circuit 311 can be formed to have a frequency characteristic for a UWB band as shown in a dotted line of FIG. 8.

Further, the filter circuit 311 can be disposed in both the transmission lines 114.

Fourth Embodiment

Figure 9:
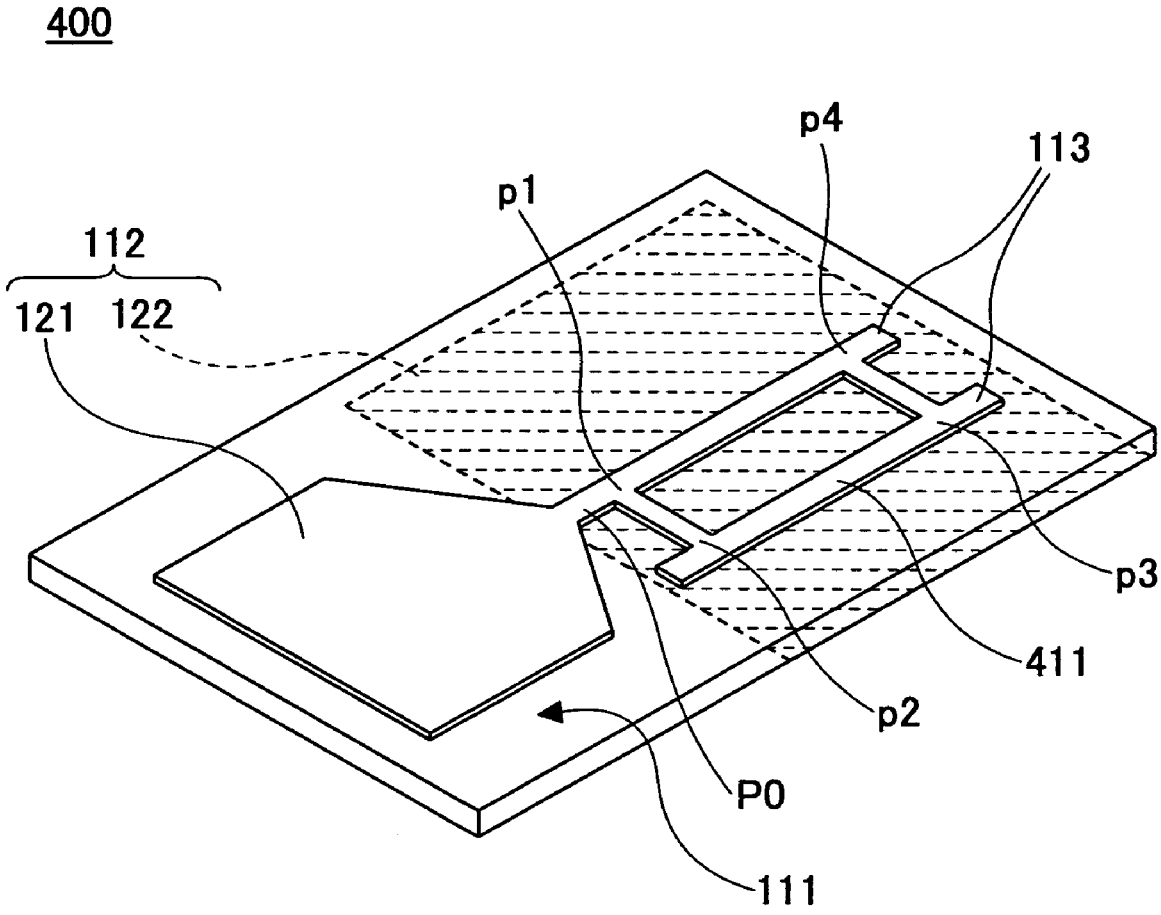
FIG. 9 is a perspective view of an antenna according to a fourth embodiment of the present invention.
Figure 10:
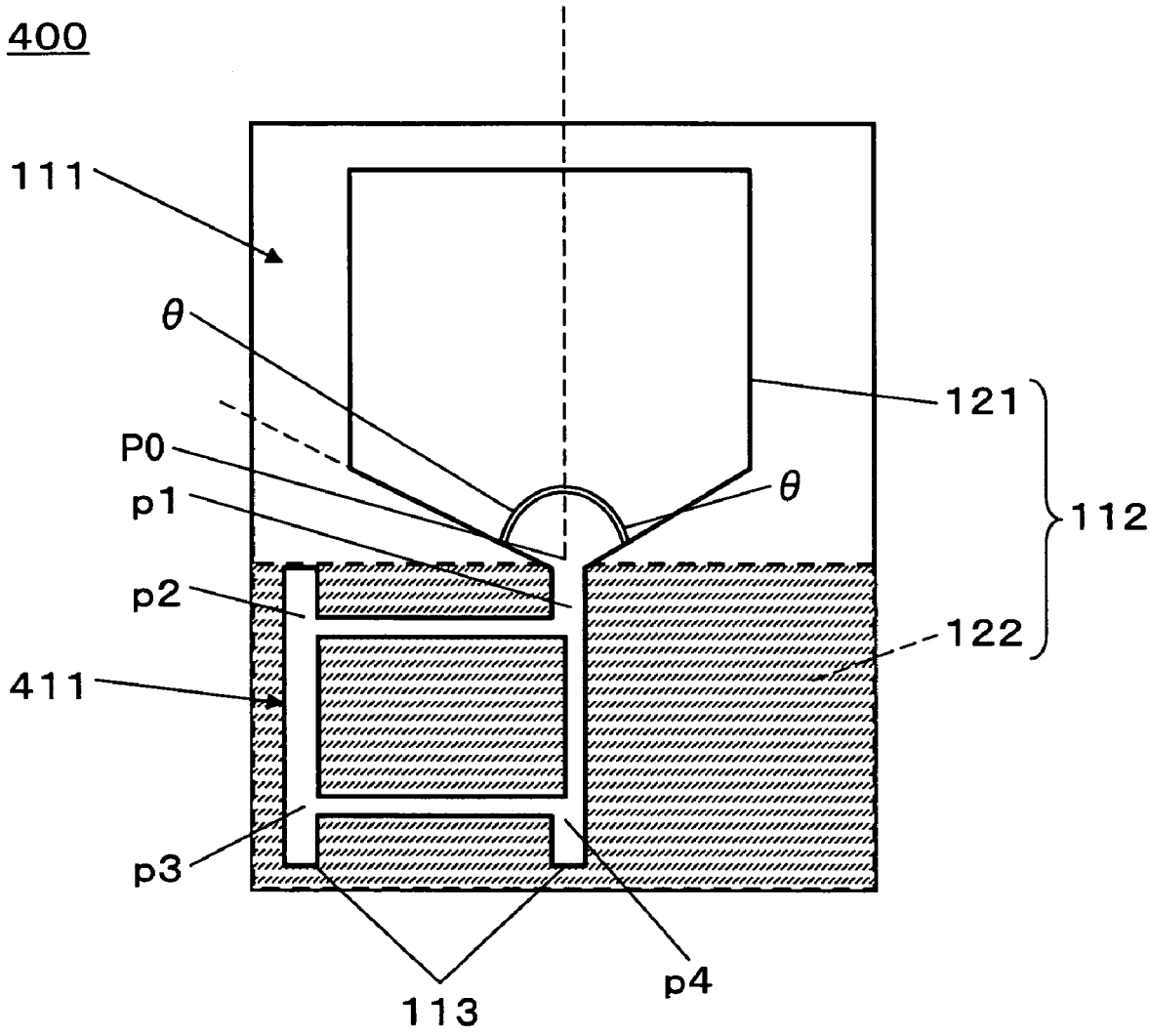
FIG. 10 is a plan view of the antenna shown in FIG. 9.

FIG. 9 is a perspective view of an antenna according to a fourth embodiment of the present invention. FIG. 10 is a plan view of the antenna shown in FIG. 9.

Referring to FIGS. 9 and 10, the antenna according to the fourth embodiment of the present invention is described. In FIGS. 9 and 10, some elements are the same as those shown in FIGS. 1 and 2, and each of the same elements has the same reference number; therefore the same description is omitted.

In an antenna 400 of the fourth embodiment of the present invention, a coupler 411 is formed between the element pattern 121 and the input/output ports 113.

The coupler 411 is formed by a hybrid circuit, for example, by a 3 dB branch line having 4 ports. The branch line type hybrid circuit in the fourth embodiment of the present invention provides a first port p1 through a fourth port p4. The power supply point P0 of the element pattern 121 is connected to the first port p1, the second port p2 is open, the third port p3 is connected to one of the input/output ports 113, and the fourth port p4 is connected to the other of the input/output ports 113.

The coupler 411 is not limited to the branch line type hybrid circuit, and can be any one of a power divider, a ¼ wavelength distribution coupling type hybrid circuit, a rat race type hybrid circuit, a phase inversion type hybrid circuit, and a Y-shaped power distributor.

According to the fourth embodiment of the present invention, since the power supply point P0 of the element pattern 121 is connected to the input/output ports 113 via some of the plural ports p1 through p4, the characteristic impedance between the element pattern 121 and the input/output ports 113 can be matched. Therefore, communications can be stable.

Fifth Embodiment

Figure 11:
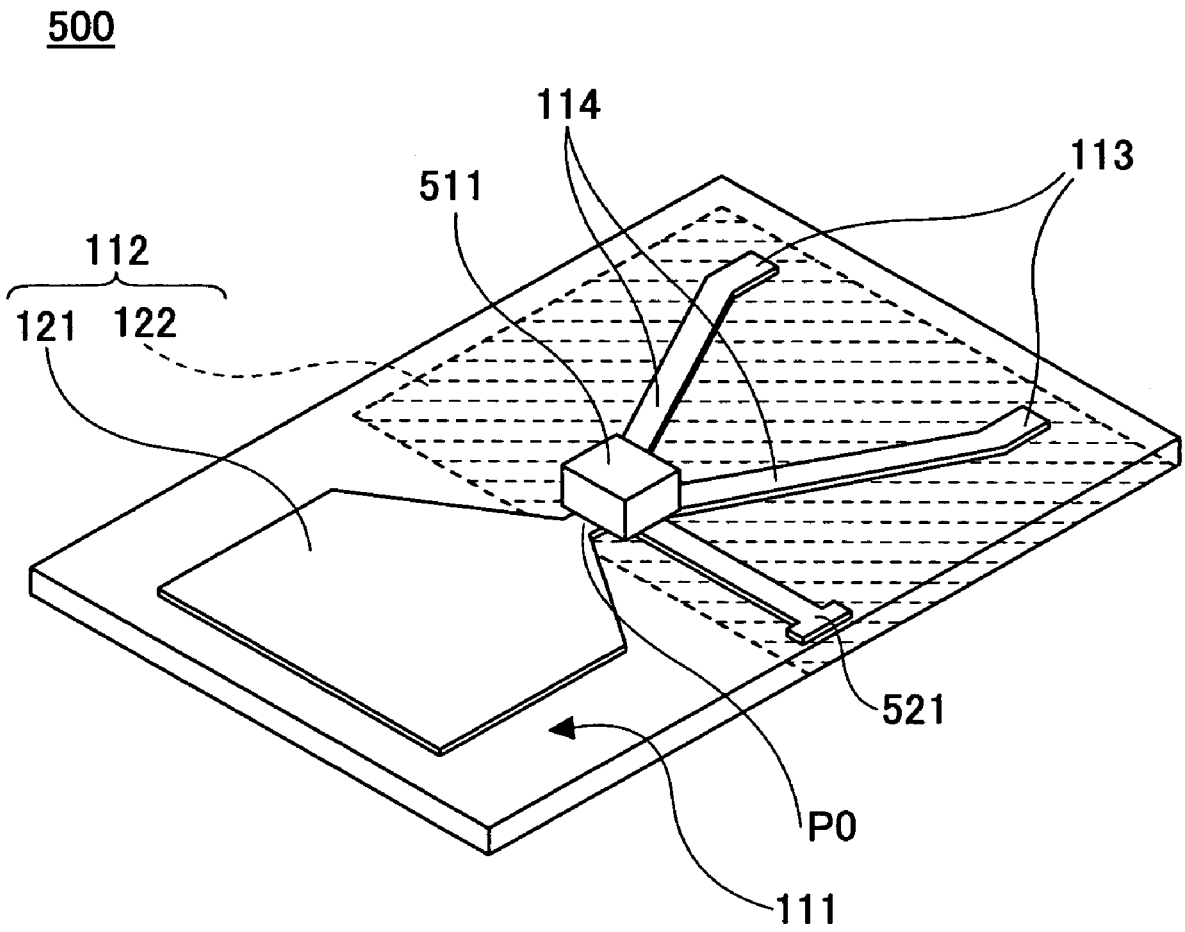
FIG. 11 is a perspective view of an antenna according to a fifth embodiment of the present invention.
Figure 12:
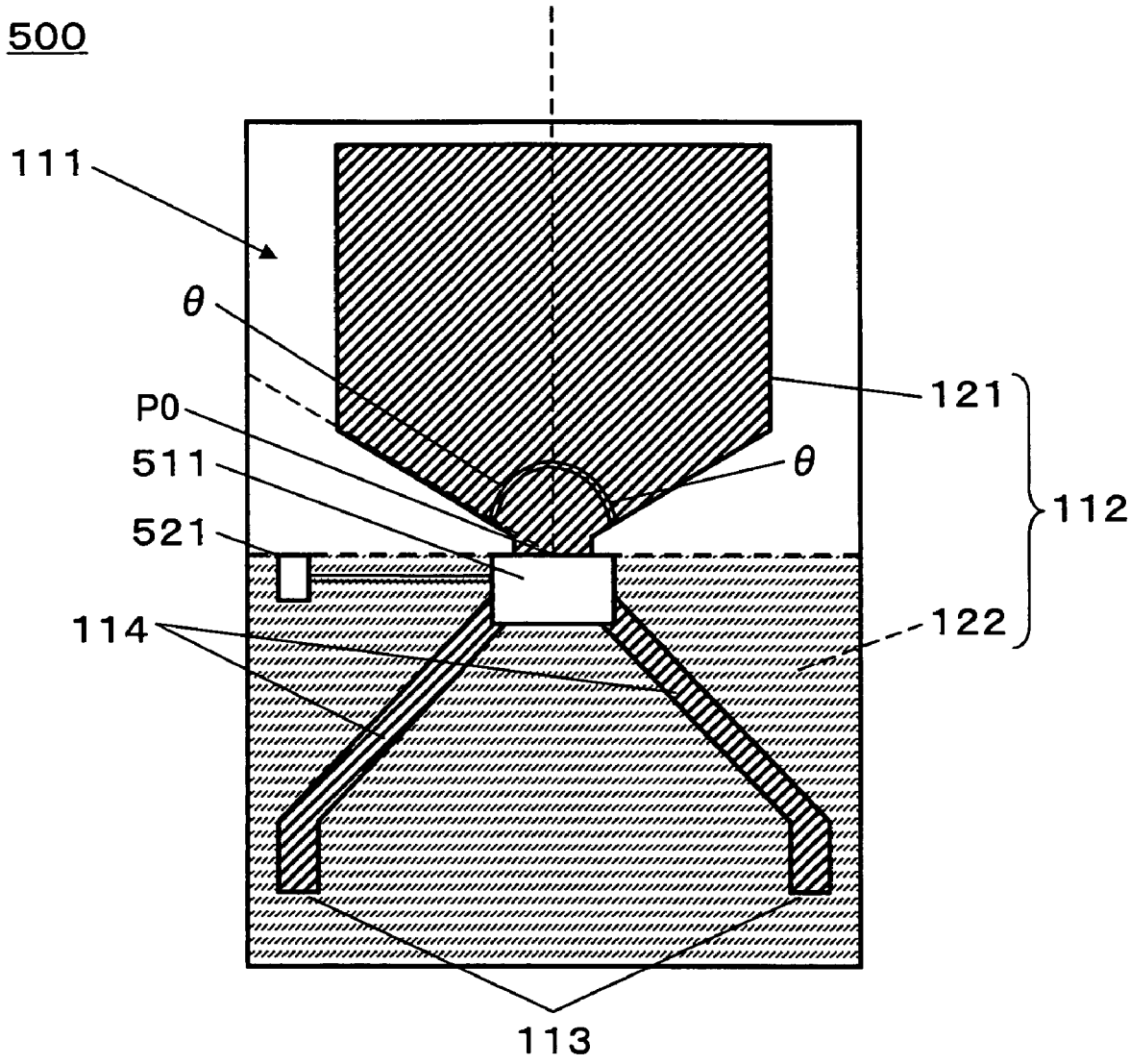
FIG. 12 is a plan view of the antenna shown in FIG. 11.
Figure 13:
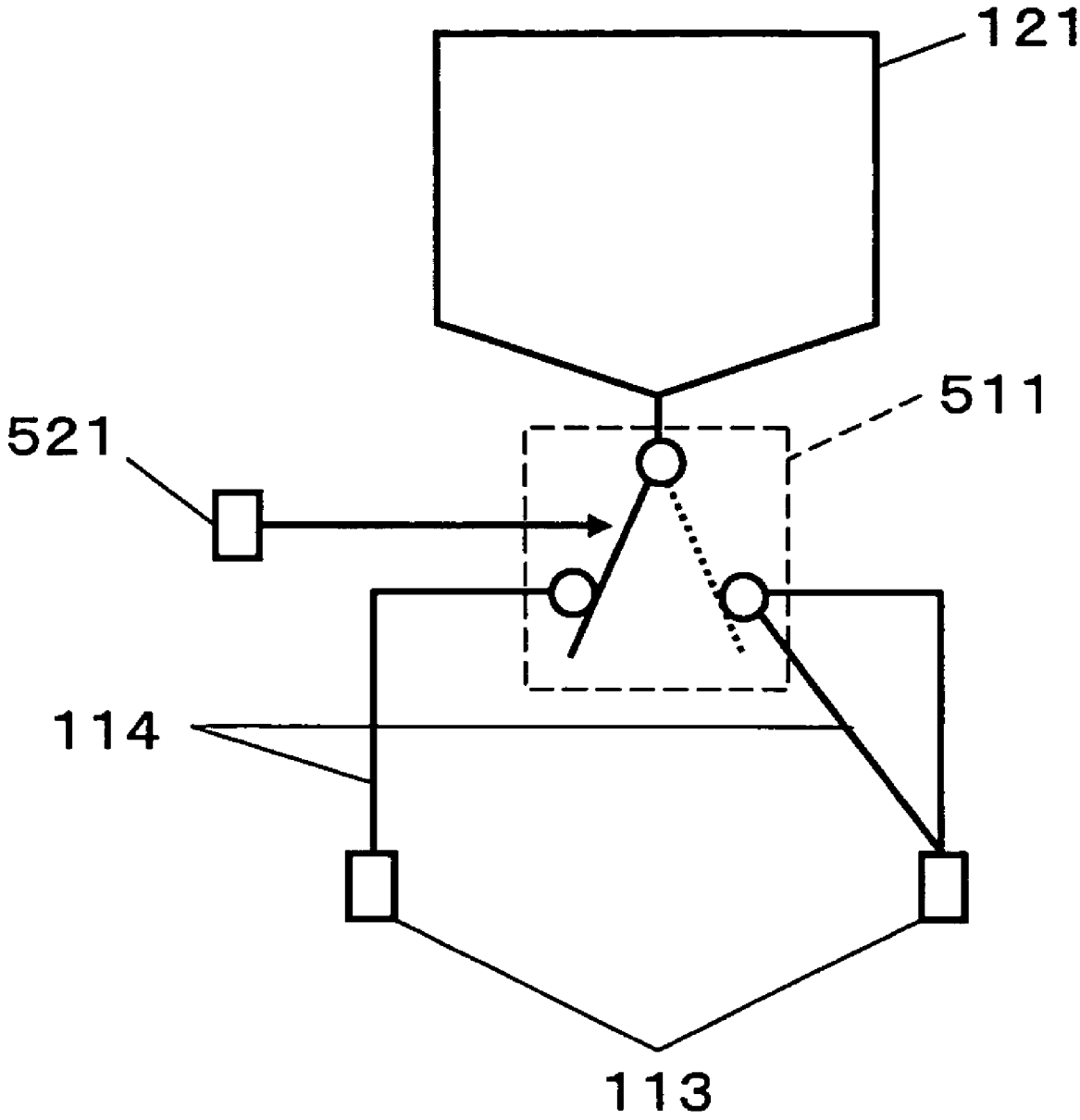
FIG. 13 is a schematic diagram showing a structure of the antenna shown in FIG. 11.

FIG. 11 is a perspective view of an antenna according to a fifth embodiment of the present invention. FIG. 12 is a plan view of the antenna shown in FIG. 11. FIG. 13 is a schematic diagram showing a structure of the antenna shown in FIG. 11.

Referring to FIGS. 11 through 13, the antenna according to the fifth embodiment of the present invention is described. In FIGS. 11 through 13, some elements are the same as those shown in FIGS. 1 and 2, and each of the same elements has the same reference number; therefore, the same description is omitted.

In an antenna 500 of the fifth embodiment of the present invention, a switching circuit 511 is disposed between the element pattern 121 and the transmission lines 114.

The switching circuit 511 is connected to a control port 521 and switches the connection between the element pattern 121 and one of the transmission lines 114 to the connection between the element pattern 121 and the other of the transmission lines 114 based on a switching signal supplied to the control port 521 from an external device (not shown).

When one of the transmission lines 114 is selected by the switching circuit 511, communications can be executed without being affected by signals from the other of the transmission lines 114.

In addition, similar to the third embodiment, when a band pass filter is formed in each of the transmission lines 114 which filter passes a predetermined frequency, communication can be stable.

Further, the present invention is not limited to these embodiments, but variations and modifications may be made without departing from the scope of the present invention.

The present application is based on Japanese Priority Patent Application No. 2006-094428 filed on Mar. 30, 2006, with the Japanese Patent Office, the entire contents of which are hereby incorporated by reference.

What is claimed is:

1. An antenna, comprising:

an antenna section which receives/transmits radio waves and includes an element pattern and a ground pattern which patterns are conductive patterns formed on a dielectric material board;

a plurality of input/output ports each of which is configured to receive a radio wave to be input to the antenna section, and to transmit a radio wave output from the antenna section; and transmission lines each of which connects the antenna section to a corresponding input/output port, wherein the element pattern, the input/output ports, and the transmission lines are formed on one surface of the dielectric material board;

the ground pattern is formed on the other surface of the dielectric material board; and a microstrip transmission line is formed of the transmission lines and the ground pattern.

2. The antenna as claimed in claim 1, wherein:

the element pattern, the ground pattern, the input/output ports, and the transmission lines are formed on one surface of the dielectric material board; and a co-planar transmission line is formed of the transmission lines and the ground pattern.

3. The antenna as claimed in claim 1, wherein:

a filter circuit is formed in the transmission line.

4. The antenna as claimed in claim 1, wherein:

the antenna section is connected to the input/output ports via a coupler instead of the transmission lines.

5. The antenna as claimed in claim 4, wherein:

the coupler is a 3 dB branch line or a power divider.

6. The antenna as claimed in claim 1, further comprising:

a switching circuit which connects the antenna section to a suitable one of the transmission lines.

7. The antenna as claimed in claim 1, wherein:

the antenna section is capable of communicating in at least a UWB frequency band and a wireless LAN frequency band.

8. An antenna, comprising:

an antenna section which receives/transmits radio waves, the antenna section including an element pattern and a ground pattern which are conductive patterns formed on a dielectric material board;

input/output ports each port being configured to receive a radio wave from the antenna section, and to transmit a radio wave to the antenna section; and transmission lines each of which connects the antenna section to a corresponding input/output port, wherein the element pattern, the ground pattern, the input/output ports, and the transmission lines are conductive patterns formed on a surface of a dielectric material board.

* * * * *